US006638074B1

(12) United States Patent
Fisher

(10) Patent No.: US 6,638,074 B1
(45) Date of Patent: Oct. 28, 2003

(54) ELECTRICAL SOCKET WITH ROTATING RECEPTACLE

(76) Inventor: Gregory S Fisher, 1 Burnett Rd., Mendham, NJ (US) 07945

( * ) Notice: Subject to any disclaimer, the term of this patent is extended or adjusted under 35 U.S.C. 154(b) by 0 days.

(21) Appl. No.: 10/084,995

(22) Filed: Feb. 27, 2002

(51) Int. Cl.[7] ..... H01R 39/00
(52) U.S. Cl. ..... 439/22; 439/18
(58) Field of Search ..... 439/11–30, 534, 439/188, 954

(56) References Cited

U.S. PATENT DOCUMENTS

| | | | | | |
|---|---|---|---|---|---|
| 2,459,032 | A | * | 1/1949 | Korth | 439/22 |
| 4,037,901 | A | * | 7/1977 | Kaszuba | 439/138 |
| 4,185,881 | A | | 1/1980 | Foley et al. | |
| 4,525,610 | A | | 6/1985 | Le Magourou | |
| 4,583,798 | A | | 4/1986 | Blazowich | |
| 4,753,600 | A | | 6/1988 | Williams | |
| 5,350,310 | A | * | 9/1994 | Chen | 439/188 |
| 5,352,122 | A | | 10/1994 | Speyer et al. | |
| 5,399,093 | A | | 3/1995 | Schneider et al. | |
| 5,429,518 | A | | 7/1995 | Chen | |
| 5,484,299 | A | * | 1/1996 | Schlessinger | 439/188 |
| 5,595,503 | A | | 1/1997 | Pittman et al. | |
| 5,725,388 | A | * | 3/1998 | Huang | 439/188 |
| 5,967,815 | A | * | 10/1999 | Schlessinger et al. | 439/188 |
| 6,015,307 | A | | 1/2000 | Chiu et al. | |
| 6,196,851 | B1 | * | 3/2001 | Gerard et al. | 439/21 |
| 6,302,743 | B1 | * | 10/2001 | Chiu et al. | 439/652 |
| 6,332,794 | B1 | * | 12/2001 | Tzeng Jeng | 439/188 |

* cited by examiner

*Primary Examiner*—Ross Gushi
(74) *Attorney, Agent, or Firm*—Michael I. Kroll

(57) ABSTRACT

A compact electrical socket with a rotating plug receptacle is provided that minimizes the amount of material required to facilitate full 360 degree rotation of the receptacle. The socket has a body with an interior into which the rotating receptacle is positioned. Pins on the exterior wall of the receptacle move within a body interior groove, positioning a receptacle forward base against a body base. The body base has stationary contact elements including a centrally positioned element and two radially disposed stationary contact elements. The receptacle base has rotating contact elements including a centrally positioned element and two radially disposed rotating contact elements, all three in continuous electrical contact as the receptacle moves through a 360 degree rotation. The corresponding rotating radially disposed contacts form arcs having lengths summing to less than 370 degrees but more than 360 degrees. The socket can be used in walls, extension cords, etc.

14 Claims, 10 Drawing Sheets

ELECTRICAL SOCKET WITH ROTATING RECEPTACLE

BACKGROUND OF THE INVENTION

1. Field of the Invention

The present invention relates generally to electrical outlets and more specifically to electrical outlets with rotating receptacles which provide variable alignment between the housing of the receptacle and the plug being inserted therein.

2. Description of the Prior Art

There are other electrical connection devices designed for rotation. Typical of these is U.S. Pat. No. 4,037,901 issued to Kaszuba on Jul. 26, 1977.

Another patent was issued to Foley et al. on Jan. 29, 1980 as U.S. Pat. No. 4,185,881. Yet another U.S. Pat. No. 4,525,610 was issued to Le Magourou on Jun. 25, 1985 and still yet another was issued on Apr. 22, 1986 to Blazowich as U.S. Pat. No. 4,583,798.

Another patent was issued to Williams on Jun. 28, 1988 as U.S. Pat. No. 4,753,600. Yet another U.S. Pat. No. 5,352,122 was issued to Speyer et al. on Oct. 4, 1994 and still yet another was issued on Mar. 21, 1995 to Schneider et al. as U.S. Pat. No. 5,399,093.

Another patent was issued to Chen on Jul. 4, 1995 as U.S. Pat. No. 5,429,518. Yet another U.S. Pat. No. 5,595,503 was issued to Pittmnan et al, on Jan. 21, 1997 and still yet another was issued on Jan. 18, 2000 to Chiu et al. as U.S. Pat. No. 6,015,307.

U.S. Pat. No. 4,037,901

Inventor: Edward H. Kaszuba

Issued: Jul. 26, 1997

An electrical safety socket in which there is no electrical contact between the socket and a plug inserted in the socket unless the plug is properly inserted in the socket, pushed in, and turned. The plug, once inserted in the socket, cannot be removed unless the reverse sequence of operations are performed. This precludes electrical contact if a child should insert a foreign metal object in the socket when the plug has been removed, or prevents the plug from being removed from the socket once inserted.

U.S. Pat. No. 4,185,881

Inventor: Jeffrey R. Foley et al.

Issued: Jan. 29, 1980

The invention relates to an electrical plug and socket arrangement. There is disclosed a plug and socket arrangement for use as a general purpose domestic electrical power outlet. The socket has a rotatable pin receiving portion which is rotatable from a first position wherein receptacles for receiving pins of the plug are electrically inactive to a second position wherein at least one receptacle is electrically active. The pin receiving portion can only be rotated to the second position when the pins are fully inserted therein because of a unique key arranged on the earth pin. The key also prevents any withdrawal of the plug in the second position, that is, when at least one of the pins is active and thus a completely child-safe plug and socket is provided.

U.S. Pat. No. 4,525,610

Inventor: Yves Le Magouroy

Issued: Jun. 25, 1985

A plug and socket connector comprises resilient contacts which are adapted to be engaged in bayonet fashion. Electrical contact between each input terminal and a corresponding socket connector-pin is established by coupling two contact studs, one contact stud being carried by a conductive arm rigidly attached to a connector pin, the other being attached to an electrical supply lead. When a plug and socket are disengaged, the contact studs being coupled are positioned in different relative angular positions with respect to the axis of the plug socket. The contact studs are placed into a position of angular coincidence by rotating the plug with respect to the socket. At the end of the rotation of the plug, each arm is subjected to an abrupt pivoting movement in which it is displaced toward an oppositely acting contact stud as a result of a release of the energy stored during the rotation.

U.S. Pat. No. 4,583,798

Inventor: Daniel L. Blazowich

Issued: Apr. 22, 1986

A rotatable electrical connector for preventing twisting and kinking of cords such as telephone and portable appliance cords includes a shell having an open-ended cylindrical bore with a series of contact elements projecting radially inwardly from the wall of the bore and a barrel rotatably received and retained in the bore with the circumference of the barrel having a series of contact rings in alignment with the contact elements. First and second electrical connectors are provided on the ends of the shell and the barrel, respectively, with the corresponding contacts electrically connected through the contact elements and contact rings.

U.S. Pat. No. 4,753,600

Inventor: O. V. Williams

Issued: Jun. 28, 1988

An electrical connector is provided for use with hand tools or the like that are normally joined to drop cords. The connector is placed between the drop cord and the electrical supply cord of the tool and allows the supply cord to be turned in a continuous clockwise or counterclockwise direction without rotation of the drop cord or twisting of the supply cord. The connector of the invention includes a pair of opposing plates which are rotatably connected whereby during rotation electrical current passes through both plates without interruption thus allowing the tool to be continuously used during an eight hour work period with the tool being directed in the same circular motion without concern of twisting or effective shortening of the supply cord.

U.S. Pat. No. 5,352,122

Inventor: Henning J. Speyer et al.

Issued: Oct. 4, 1994

An electrical connector is formed from two pairs of contacts. One pair of contacts is rotatable with respect to the other pair of contacts. Both pairs are in conductive and frictional engagement throughout a 90 degree rotational distance. One pair of contacts have an arcuate conductive contact surface, each contact being symmetrically arranged with respect to the axis of rotation, in opposed relation to one another and separated at each end by a nonconductive space. One pair of contacts are attached to a pair of male electrical prongs. The other pair of contacts are attached to an electrical appliance. The one pair of contacts and the attached pair of male electrical prongs are themselves attached to a nonconductive disk. The nonconductive disk is disposed in a circular groove in a disk holder. The nonconductive disk and the pair of contacts and electrical prongs attached thereto are rotatable within the circular groove. Stops are employed to limit the rotational distance to 90 degree. The electrical connector allows an electrical appliance, such as a night light, attached to the connector to be oriented in a desired direction regardless of whether an outlet is vertically or horizontally disposed.

U.S. Pat. No. 5,399,093

Inventor: Roy J. Schneider et al.

Issued: Mar. 21, 1995

A low profile rotatable electrical plug includes a housing and a set of conductive prongs positioned on one face of the housing for insertion into a conventional wall outlet. A power cord exits the housing in a direction generally perpendicular to the prongs such that the cord parallels the wall when the plug is inserted into a wall outlet. A rotative coupling device mounted within the housing provides a rotative electrical connection between the power cord and the prongs. The rotative coupling device includes first and second sets of conductors carried by respective conductor support plates. The conductors in the first support plate are electrically connected to respective conductors in the power cord, and the conductors in the second support plate are electrically connected to respective prongs. The first support plate is fixedly mounted within the housing and the second support rotates within the housing relative to the first support plate. The prongs extend from the second support plate and through an aperture in the housing for rotation relative to the cord. The plug further includes structure for releasably locking the position of the power cord with respect to the prongs.

U.S. Pat. No. 5,429,518

Inventor: Ken C. Chen

Issued: Jul. 4, 1995

A socket terminal has a shell, two electrodes, a ground and at least one socket member. The shell has a base and a cover which is mounted on the base. The base has a first side which defines two grooves for receiving the electrodes and a second side which defines a channel for receiving the ground. The base further defines at least one aperture. The socket member has a casing which has a disk-shaped shaft formed thereon whereby the disk-shaped shaft is received in the opening defined in the cover so that the casing is pivotable between a first position and a second position. Two conductive strips each has a first end received in the casing and a second end disposed below the casing. A grounded strip has a first end received in the casing and a second end disposed secured to the casing by means of a screw with a relatively large head. The head of the screw is inserted through the aperture defined in the base and is further engaged with the ground. The second ends of the conductive strips contact the electrodes when the casing is in the first position. The second ends of the conductive strips do not contact the electrodes when the casing is in the second position. The second end of the grounded strip is always engaged with the ground.

U.S. Pat. No. 5,595,503

Inventor: Carl R. Pittman et al.

Issued: Jan. 21, 1997

A rotatable electrical plug and power cord for mating with a conventional electrical outlet comprises a housing first portion and a housing second portion rotatably coupled to the housing first portion. The housing first portion carries first and second electrically conductive outlet prongs extend from the housing first portion a sufficient distance to permit the prongs to engage into an electrical outlet. The housing second portion is connected to the proximal end of a power cord such that the power cord can rotate relative to the prongs. The power has a pair of electrical conductors extending between its proximal and distal ends. A flexible conductor means electrically interconnects the power cord conductors with the respective prongs and permits the housing first portion to rotate relative to the housing second portion without imparting forces on the power cord conductors. The flexible conductor means may comprise a pair of multiwire conductors, each of which extends between a power cord conductors and a respective prongs. The multiwire conductors are substantially more flexible than the conductors traditionally used in a power cord and, as a result, are able to withstand the bending and twisting forces imparted on them during rotation of the housing portions relative to each other.

U.S. Pat. No. 6,015,307

Inventor: Pen-Fu Chiu et al.

Issued: Jan. 18, 2000

An electric outlet includes a casing having a longitudinal row of split bolts on the middle and two longitudinal row of locating blocks at two opposite sides of the split bolts, a grounding strip and two metal conductive strips respectively fastened to the longitudinal row of split bolts and the longitudinal rows of the locating block and respectively connected to the conductors of the three wires of a three-wire electric wire, a plurality of rotary socket bodies respectively and mounted on split bolts, each rotary socket body having insertion slots for receiving the metal blade and grounding prong of an electric plug, and a cover shell covered on the casing to hold the rotary socket bodies in place, wherein when an electric plug is installed in one rotary socket body, the rotary socket body can be rotated on the respective split bolt between "ON" and "OFF" positions.

While these rotating electrical connection devices may be suitable for the purposes for which they were designed, they would not be as suitable for the purposes of the present invention, as hereinafter described. It is thus desirable to provide an electrical socket consisting of stationary components and components that rotate allowing a plug to be inserted into the receptacle with variable alignment relative to the housing of the receptacle. It is particularly desirable to provide an electrical socket that is compact and minimizes the number of components and materials required to facilitate full 360 degree rotation.

SUMMARY OF THE PRESENT INVENTION

A primary object of the present invention is to provide an electrical socket having one or more receptacles consisting of stationary components and components that rotate to allow the plug to be inserted with variable alignment relative to the housing of the receptacle.

Another object of the present invention is to provide an electrical outlet having rotatable receptacles that allows an electrical plug to be inserted into the receptacle from more than one orientation.

Yet another object of the present invention is to provide an electrical outlet having rotatable receptacles consisting of moving contacts through which electrical connectivity between the stationary components and the rotating components is established.

Still yet another object of the present invention is to provide an electrical outlet having rotatable receptacles that rotate within their own housing.

Yet another object of the present invention is to provide an electrical outlet having rotatable receptacles that may accept any electrical plug of two or more prongs.

Another object of the present invention is to provide an electrical outlet having rotatable receptacles that is simple and easy to use.

One other object of the present invention is to provide an electrical outlet having rotatable receptacles that is economical in cost to manufacture, having a minimum number of components, and optimizing the required amount of high cost conductive metals.

Additional objects of the present invention will appear as the description proceeds.

The present invention overcomes the shortcomings of the prior art by providing an electrical outlet having rotatable receptacles that may accept any electrical plug of two or more prongs. The present invention includes stationary components and components that rotate relative to the stationary components to allow an electrical plug to be inserted into a receptacle at any angle within a 360 degree orientation. The present invention further includes moving contacts, pins, sliding contacts, flexible wires or any combination thereof through which electrical connectivity between the stationary components and the rotating components is established.

Each electrical receptacle of the present invention rotates within its housing so that the plug being inserted into the electrical receptacle can be inserted at any suitable orientation after aligning the rotating components of the receptacle within its housing to the alignment of the plug.

The prongs that can be inserted may be of any combination of some or all prong configurations used in any country.

The receptacle of the present invention may be for any single or multiple combination of voltage, amperage and power.

The receptacle housing can be any flush surface mounted, recessed surface mounted, surface protruding mounted, at the end of or within the length of a rigid electrical extension, at the end of or within the length of a flexible electrical extension, or in any combination of those possible forms of mounting.

Multiple rotating sockets may be housed within a single receptacle housing. The shape of the receptacle housing can be of any geometry.

The receptacle covers of the present invention may be constructed with or with out a temporary cover, a permanent cover, a removable cover or a supplemental cover.

Each rotating receptacle may be accompanied by none, one or more,other receptacles of either the fixed type or the rotating type within the same receptacle housing.

An electrical socket is providing for electrically connecting power source wires to an electrical plug having prongs, comprising: a body having a base and an interior wall forming a body interior, the interior wall having a radial groove; a receptacle within the body interior, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs, substantially all of the at least two prong receptacles being positioned within the portion of the receptacle that is within the body interior; at least two rotating electrical contact elements fixed to the receptacle base, the receptacle rotating contact elements rotating with the receptacle; and at least two stationary electrical contact elements on the body base adapted to be connected to the power source wires, each of the at least two body stationary contact elements being in constant electrical connectivity with one of the at least two rotating contact elements as the receptacle is rotated through 360 degrees.

In one embodiment, the receptacle rotating contact elements include a rotating first contact element centrally disposed on the receptacle base, and the body stationary contact elements include a stationary first contact element centrally disposed on the body base, the stationary first contact element being in constant electrical connectivity with the rotating first contact element as the receptacle is rotated through 360 degrees; and the receptacle rotating contact elements include a rotating second contact element radially disposed on the receptacle base, and the body stationary contact elements include a stationary second contact element radially disposed on the body base, the stationary second contact element being in constant electrical connectivity with the rotating second contact element as the receptacle is rotated through 360 degrees.

In one embodiment, the receptacle rotating second contact element extends radially to form an arc having a length and the body stationary second contact element extends radially to form an arc having a length, the two arc lengths summing to less than 720 degrees but more than 360 degrees.

In one embodiment, the receptacle rotating second contact element extends radially to form an arc having a length and the body stationary second contact element extends radially to form an arc having a length, the two arc lengths summing to less than approximately 370 degrees but more than 360 degrees.

In one embodiment, the receptacle rotating contact elements and the body stationary contact elements include a receptacle rotating first contact element in electrical connectivity with a body stationary first contact element, a receptacle rotating second contact element in electrical connectivity with a body stationary second contact element, and a receptacle rotating third contact element in electrical connectivity with a body stationary third contact element.

In one embodiment, the receptacle rotating contact elements include at least four contact elements, and the body stationary contact elements include at least four contact elements, each of the at least four receptacle rotating contact elements being in electrical connectivity with one of the at least four body stationary contact elements.

In one embodiment, the socket further comprises an electric cord having a first end, the first end having an electrical plug, and a second end, the second end being attached to the socket such that electricity is delivered from an electric power source through the first end plug then to the body stationary electrical contact elements in the socket.

In one embodiment, the socket further comprises an electrical socket wall housing for positioning at least one of the sockets in a wall.

In one embodiment, the receptacle rotating contact elements include a rotating first contact element centrally disposed on the receptacle base, and the body stationary contact elements include a stationary first contact element centrally disposed on the body base, the stationary first contact element being in constant electrical connectivity with the rotating first contact element as the receptacle is rotated through 360 degrees; the receptacle rotating contact elements include a rotating second contact element radially disposed on the receptacle base, and the body stationary contact elements include a stationary second contact element radially disposed on the body base, the stationary second contact element being in constant electrical connectivity with the rotating second contact element as the receptacle is rotated through 360 degrees; and the receptacle rotating contact elements include a rotating third contact element radially disposed on the receptacle base, and the body stationary contact elements include a stationary third contact element radially disposed on the body base, the stationary third contact element being in constant electrical connectivity with the rotating third contact element as the receptacle is rotated through 360 degrees.

In another embodiment, there is provided an electrical socket for electrically connecting power source wires to an electrical plug having prongs, comprising: a body having a base and an interior wall forming a body interior, the interior wall having a radial groove; a receptacle within the body, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs; a rotating first electrical contact element centrally disposed on the receptacle base and a stationary first contact element centrally disposed on the body base and in constant electrical connectivity with the rotating first contact element as the receptacle is rotated through 360 degrees; and a rotating second electrical contact element radially disposed on the receptacle base and a stationary second contact element radially disposed on the body base, the stationary second contact element being in electrical connectivity with the power source wires and in constant electrical connectivity with the rotating second contact element as the receptacle is rotated through 360 degrees, the rotating second contact element extending radially to form an arc having a length and the stationary second contact element extending radially to form an arc having a length, the two arc lengths summing to less than approximately 370 degrees but more than 360degrees.

In one embodiment, substantially all of the at least two prong receptacles are positioned within the portion of the receptacle that is within the body interior.

In another embodiment, a socket is provided for electrically connecting power source wires to an electrical plug having prongs, comprising: a body having a base and an interior wall forming a body interior, the interior wall having a radial groove; a receptacle within the body, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs; a rotating first electrical contact element centrally disposed on the receptacle base and a stationary first contact element centrally disposed on the body base and in constant electrical connectivity with the rotating first contact element as the receptacle is rotated through 360 degrees; and a rotating second electrical contact element radially disposed on the receptacle base and a stationary second contact element radially disposed on the body base, the stationary second contact element being in electrical connectivity with the power source wires and in constant electrical connectivity with the rotating second contact element as the receptacle is rotated through 360 degrees, the rotating second contact element extending radially to form an arc having a length and the stationary second contact element extending radially to form an arc having a length, the two arc lengths summing to less than 720 degrees but more than 360 degrees.

In one embodiment, substantially all of the at least two prong receptacles are positioned within the portion of the receptacle that is within the body interior.

In another embodiment, an electrical socket is provided for electrically connecting power source wires to an electrical plug having prongs, comprising: a body having a base and an interior wall forming a body interior, the interior wall having a radial groove; a receptacle within the body interior, the receptacle having a base and a generally circular exterior and two pins positioned on the exterior and placed within the body groove such that the receptacle is rotatable within the body as the two pins move within the groove, the receptacle further having three prong receptacles for receiving the electrical plug prongs and electrically connecting with the prongs, substantially all of the three prong receptacles being positioned within the portion of the receptacle that is within the body interior; a first, second and third receptacle rotating electrical contact element fixed to the receptacle base; a first, second and third body stationary electrical contact element on the body base adapted to be connected to the power source wires; the receptacle rotating first contact element being centrally disposed on the receptacle base, and the body stationary first contact element being centrally disposed on the body base, the stationary first contact element being in constant electrical connectivity with the rotating first contact element as the receptacle is rotated through 360 degrees; the receptacle rotating second contact element being radially disposed on the receptacle base, and the body stationary second contact element being radially disposed on the body base, the stationary second contact element being in constant electrical connectivity with the rotating second contact element as the receptacle is rotated through 360 degrees; and the receptacle rotating third contact element being radially disposed on the receptacle base, and the body stationary third contact element being radially disposed on the body base, the stationary third contact element being in constant electrical connectivity with the rotating third contact element as the receptacle is rotated through 360 degrees.

In another embodiment, there is provided an electrical socket for electrically connecting power source wires to an electrical plug having prongs, comprising: a body having a base and an interior wall forming a body interior; a receptacle positioned for rotation within the body, the receptacle having at least two prong receptacles for receiving the electrical plug prongs and electrically connecting with the prongs, substantially all of the at least two prong receptacles being positioned within the portion of the receptacle that is within the body interior; means for guiding and restraining the receptacle when the receptacle is rotated within the body interior; and means for establishing continued electrical connectivity between the at least two prong receptacles and the power source wires as the receptacle rotates through 360 degrees.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
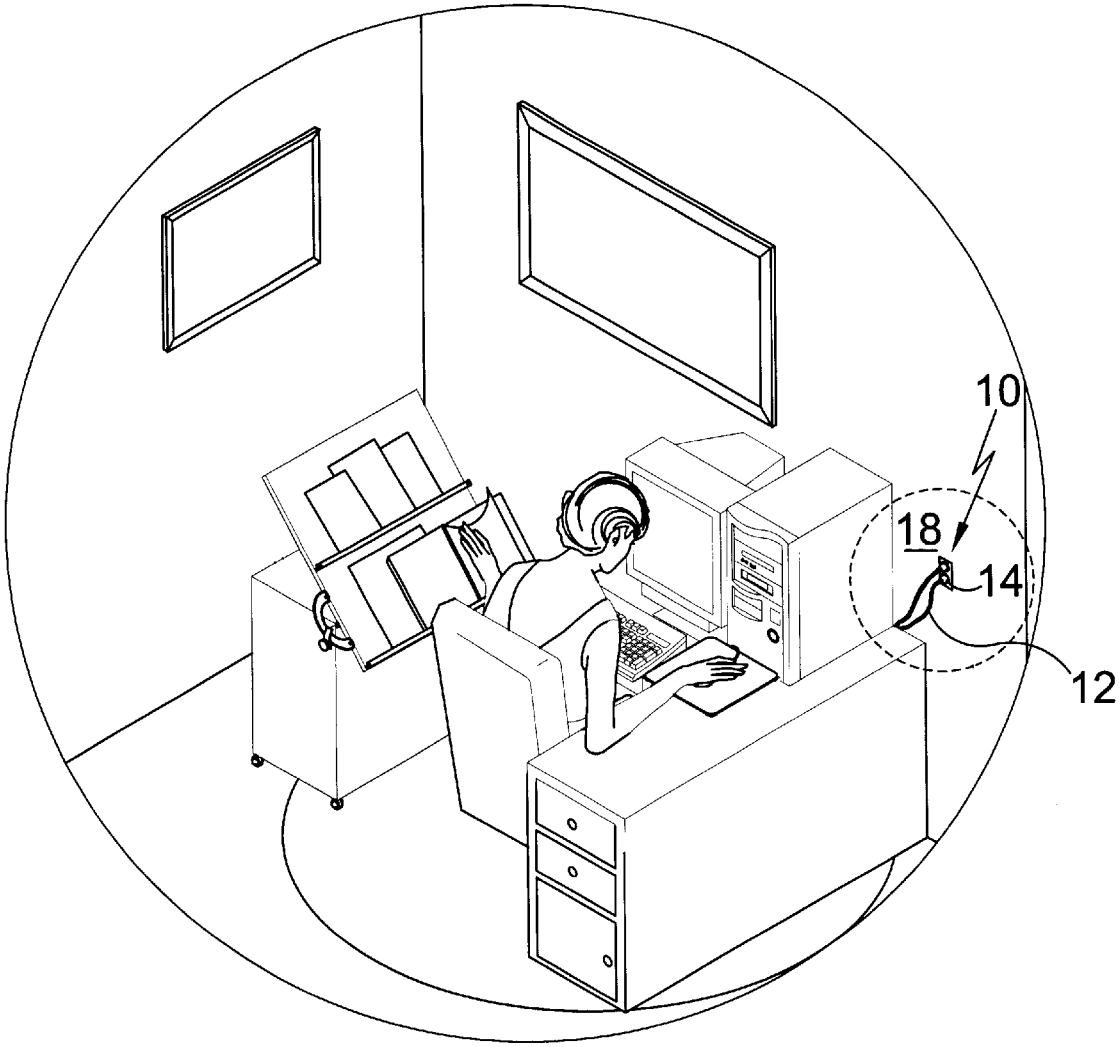
FIG. 1 is a pictorial illustration of the present invention in use for a two socket configuration.
Figure 2:
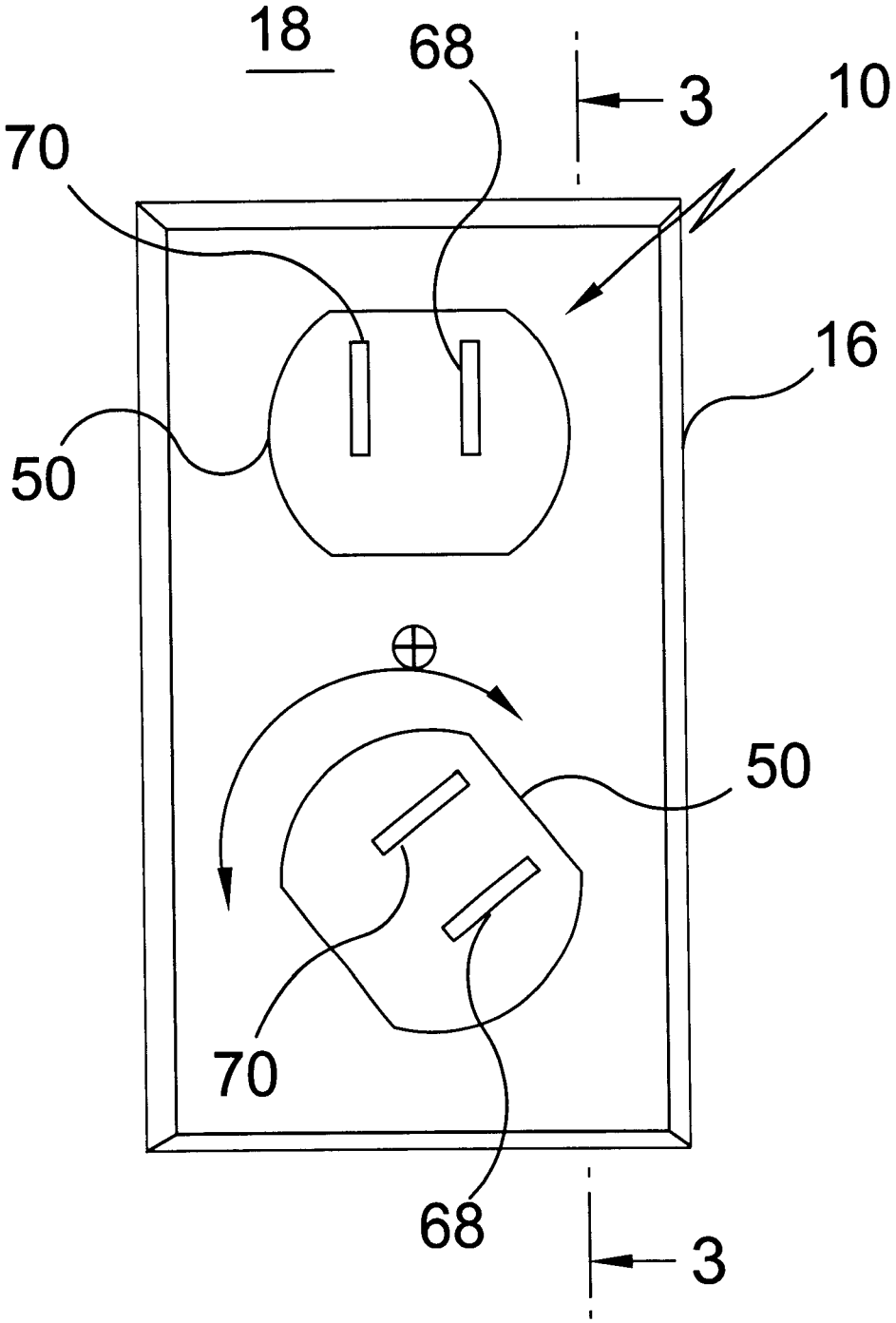
FIG. 2 is a front view of the present invention for a two socket configuration.

Turning now descriptively to the drawings, in which similar reference characters denote similar elements throughout the several views, the figures illustrate the Electrical Socket with Rotating Receptacle of the present invention. With regard to the reference numerals used, the following numbering is used throughout the various drawing figures.

10 Electrical Socket With Rotating Receptacle
12 electrical cord
14 electrical cord plug
16 face plate
18 wall
20 outlet housing
22 building wiring
24 bracket
26 bracket screws
30 body
32 body interior wall
34 body groove
36 stationary centrally positioned contact element
38 connection—centrally positioned stationary contact element to building wire
40 stationary arcuate contact element
42 connection—arcuate stationary contact element to building wire
50 rotating electrical receptacle
52 rotating electrical receptacle exterior
54 rotating electrical receptacle pin
56 rotating electrical receptacle base
58 first prong receptacle
60 rotating centrally positioned contact element
62 second prong receptacle
64 rotating arcuate contact element
66 rotating electrical receptacle face
68 rotating electrical receptacle face first prong slot
70 rotating electrical receptacle face second prong slot
100 alternate socket
102 body
104 rotating electrical receptacle
106 first prong slot
108 second prong slot
110 third prong slot
112 rotating centrally positioned contact element
114 rotating first arcuate contact element
116 rotating second arcuate contact element
118 stationary centrally positioned contact element
120 stationary first arcuate contact element
122 stationary second arcuate contact element

DETAILED DESCRIPTION OF THE PREFERRED EMBODIMENTS

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 3:
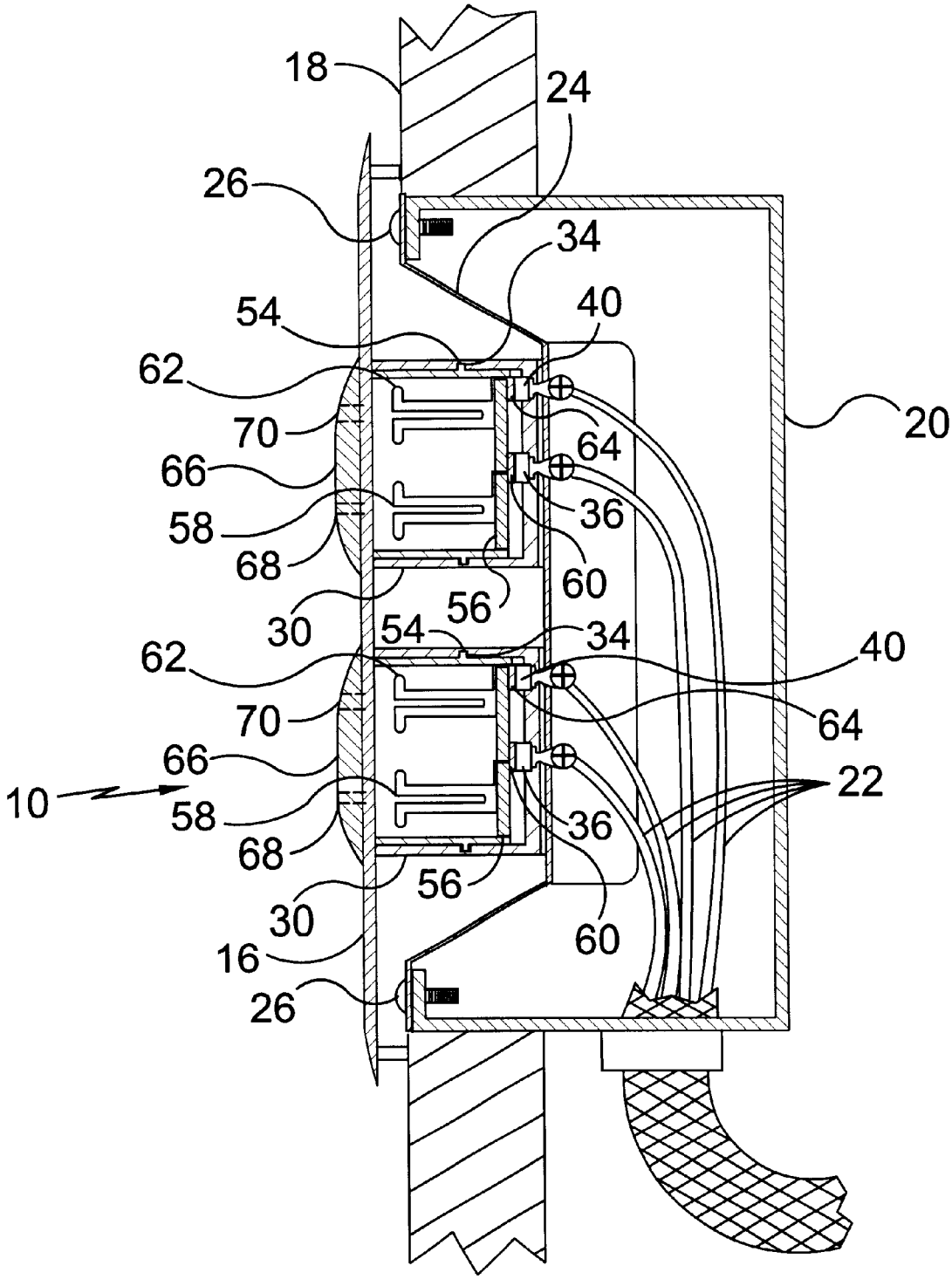
FIG. 3 is a sectional side view of the present invention for a two socket, two prong configuration.

FIGS. 1–10 depict various embodiments of the socket with rotating receptacle 10 of the present invention. The socket 10 is shown being used in FIG. 1, where a typical electrical cord 12 with a plug 14 is plugged into a two-socket face plate 16 on an office wall 18. The socket 10, typically two of them, are positioned in a housing 20 set in the wall 18. As shown in FIG. 3, the housing 20 receives the building wire 22 bundle and also supports a bracket 24. Screws 26 typically attach the bracket 24 to the housing 20.

For each socket 10, the present invention provides a body 30 with a generally circular interior wall 32. A groove 34 runs about the circumference of the interior wall 32. On the rear of the body 30, and disposed toward the interior is a centrally positioned electrical contact element 36. Connection element 38 connects this central stationary contact element 36 to a building wire 22.

Also on the rear of the body 30 and disposed toward the interior is a stationary arcuate electrical contact element 40, connected to a second building wire 22, using connection element 42.

A rotating electrical receptacle 50 has a generally circular exterior 52 with two pins 54 sized and positioned to rotated within the body groove 34 when the receptacle 50 is positioned within the body 30. The groove extends completely around the body interior wall 32, such that the receptacle 50 can rotate through a complete revolution.

The receptacle 50 has a base 56 to which a first prong receptacle 58 is attached, the first prong receptacle 58 extending through the base 56 for attachment with a rotating centrally positioned electrical contact element 60. A second prong receptacle 62 is attached to the rotating receptacle base 56 and extending through the base 56 for attachment to a rotating arcuate electrical contact element 64.

Figure 4:
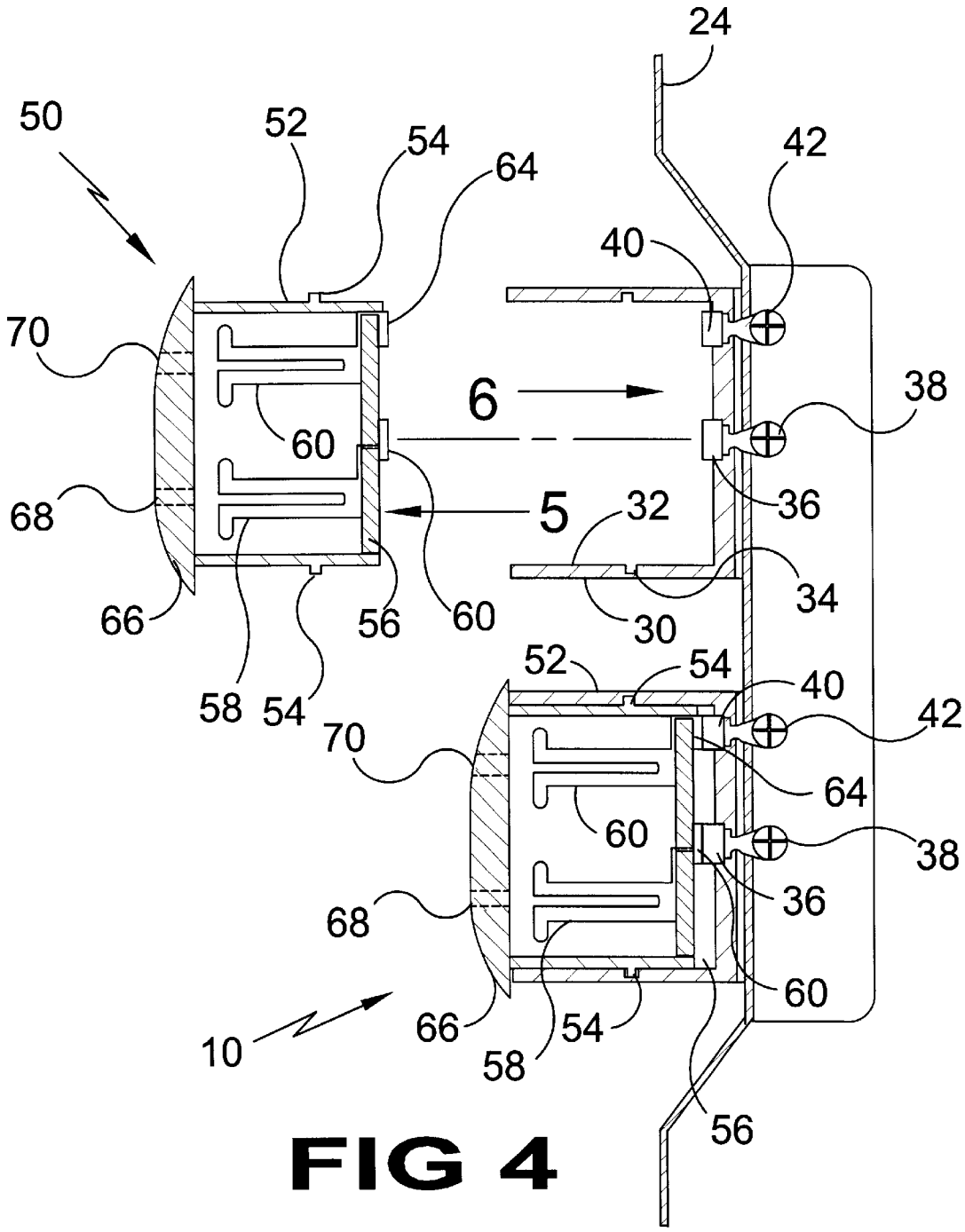
FIG. 4 is a sectional side view of the present invention for a two socket, two prong configuration.

When the pins 54 are in the body groove 34, the stationary centrally disposed contact element 36 is in contact with the rotating centrally positioned contact element 60, as shown in FIGS. 3–4. This contact is maintained throughout the entire 360 degree rotation of the rotating receptacle 50.

Similarly, when the pins 54 are in the body groove 34, the stationary arcuate contact element 40 is in continuous contact with the rotating arcuate contact element 64 throughout the full 360 degree rotation.

Figure 5:
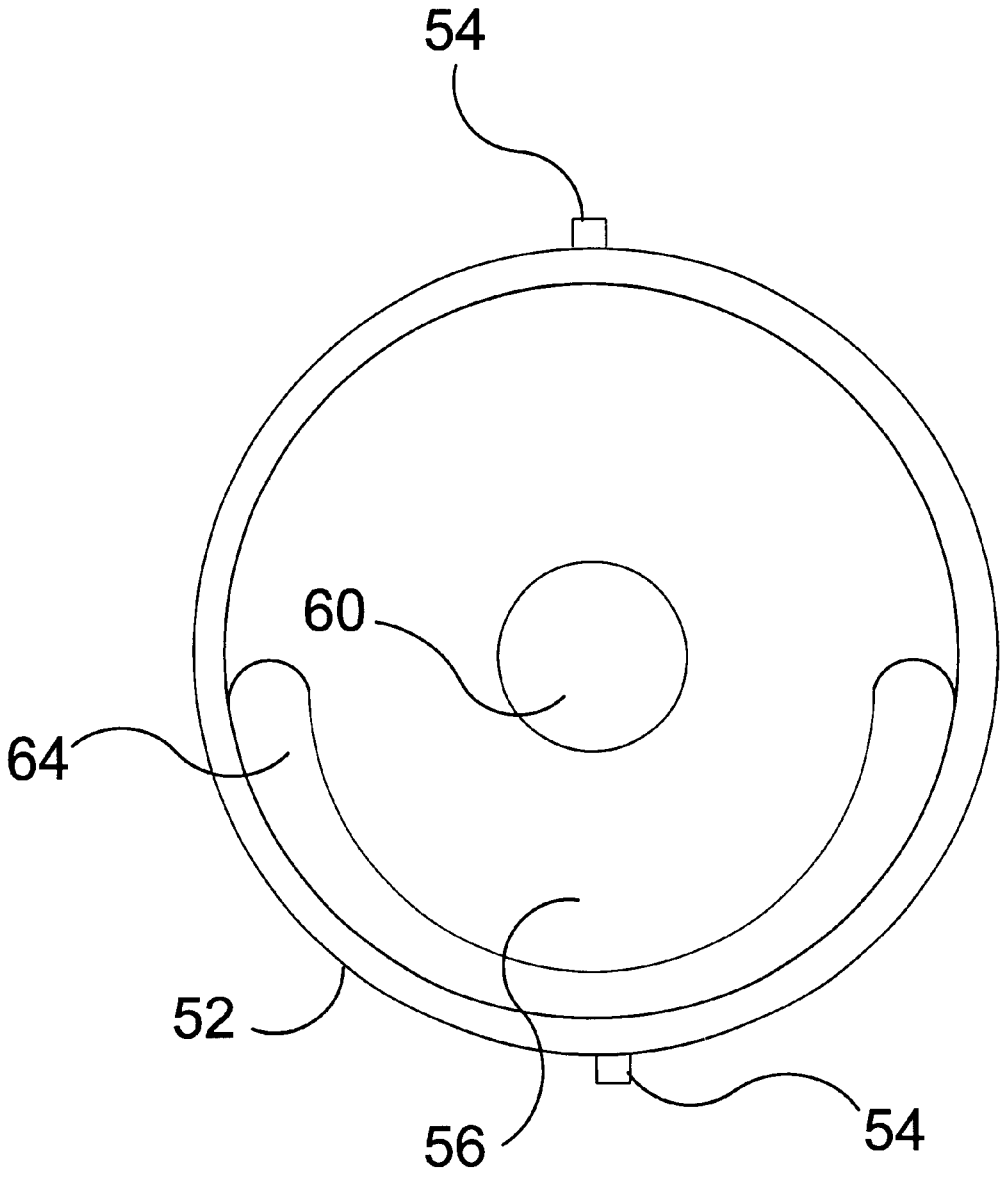
FIG. 5 is an inside view of the rotating receptacle contact port depicting the rotating arcuate and centrally positioned electrical contact elements.
Figure 6:
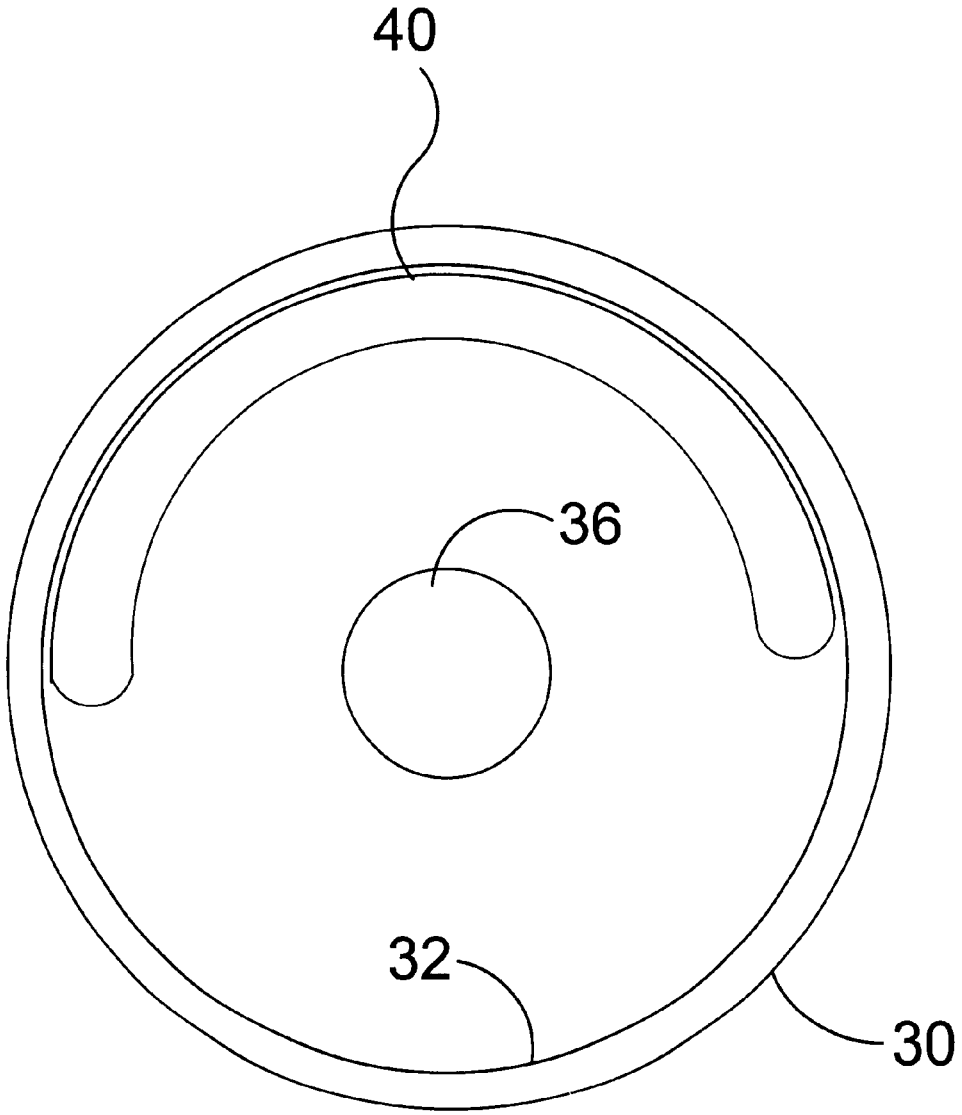
FIG. 6 is an inside view of the rotating receptacle contact port depicting the stationary arcuate and centrally positioned electrical contact elements.

In the present invention, the arcs formed by the stationary and rotating arcuate contact elements 40,64 have lengths that sum to over 360 degrees. Optimally, in light of the desire to minimize the amount of material required for these components, the sum will be less than approximately 370 degrees, as shown in FIGS. 5–6. If the sum is more than 360 degrees and less than 370 degrees these contact elements 40,64 will always be in electrical contact regardless of the rotational position of the rotating receptacle 50. At the same time, however, the amount of material required for these contact elements 40,64 has been nearly halved.

The rotating receptacle 50 also includes a typical face member 66 having a first prong slot 68 and a second prong slot 70. The first prong slot 68 is aligned with the first prong receptacle 58 such that the first prong receptacle 58 receives the first plug prong when the same is inserted into the first prong slot 68. When so received by the first prong receptacle 58, the first prong is in electrical communication with the appropriate building wire 22 through the rotating centrally positioned contact element 60, the stationary centrally positioned contact element 36, and connection element 38.

In similar fashion, when the second prong is received by the second prong receptacle 70, the second prong is in electrical communication with the appropriate building wire 22 through the rotating arcuate contact element 64, the stationary arcuate contact element 40, and connection element 42.

Figure 7:
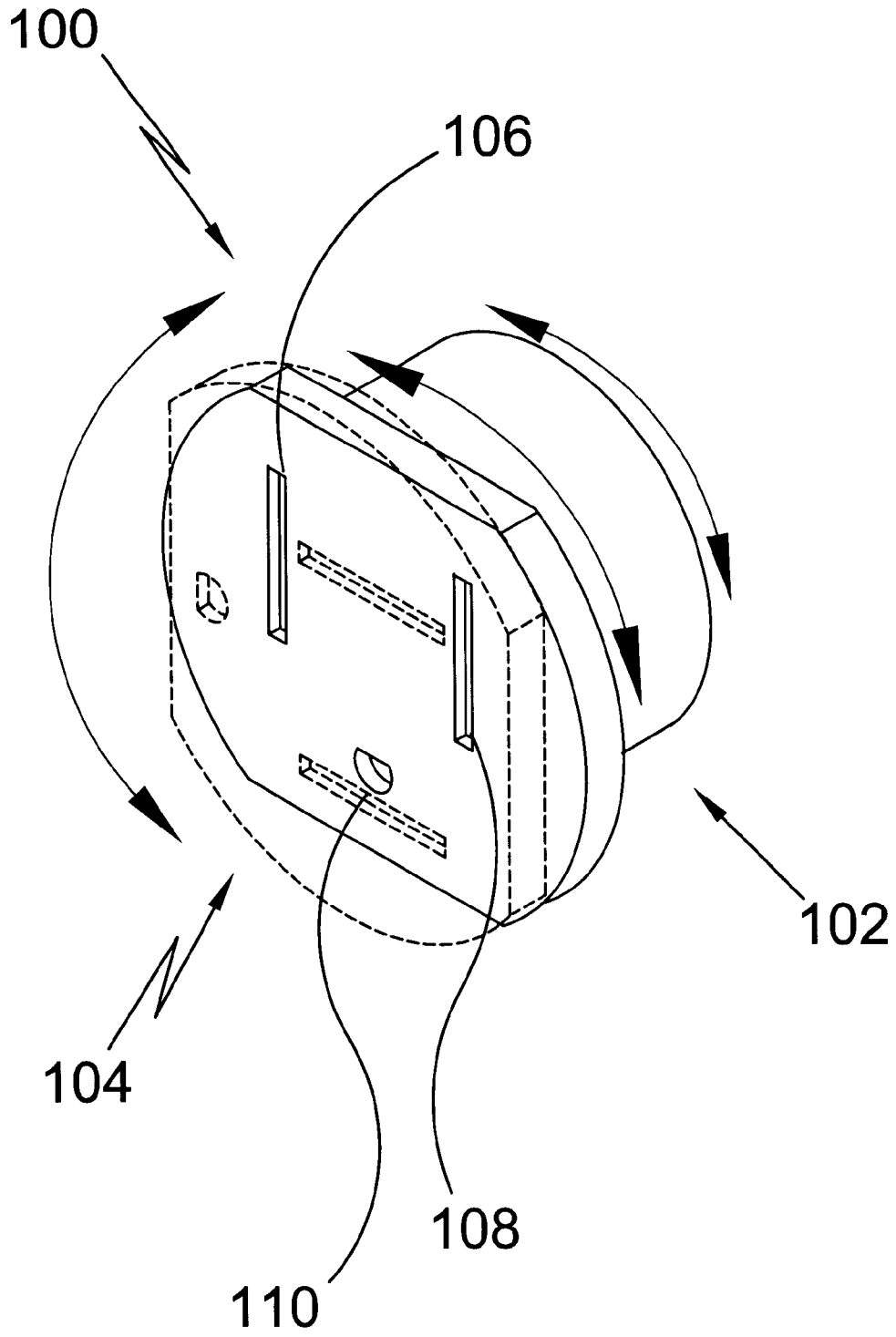
FIG. 7 is a perspective view of the rotating receptacle for a three prong plug embodiment.
Figure 9:
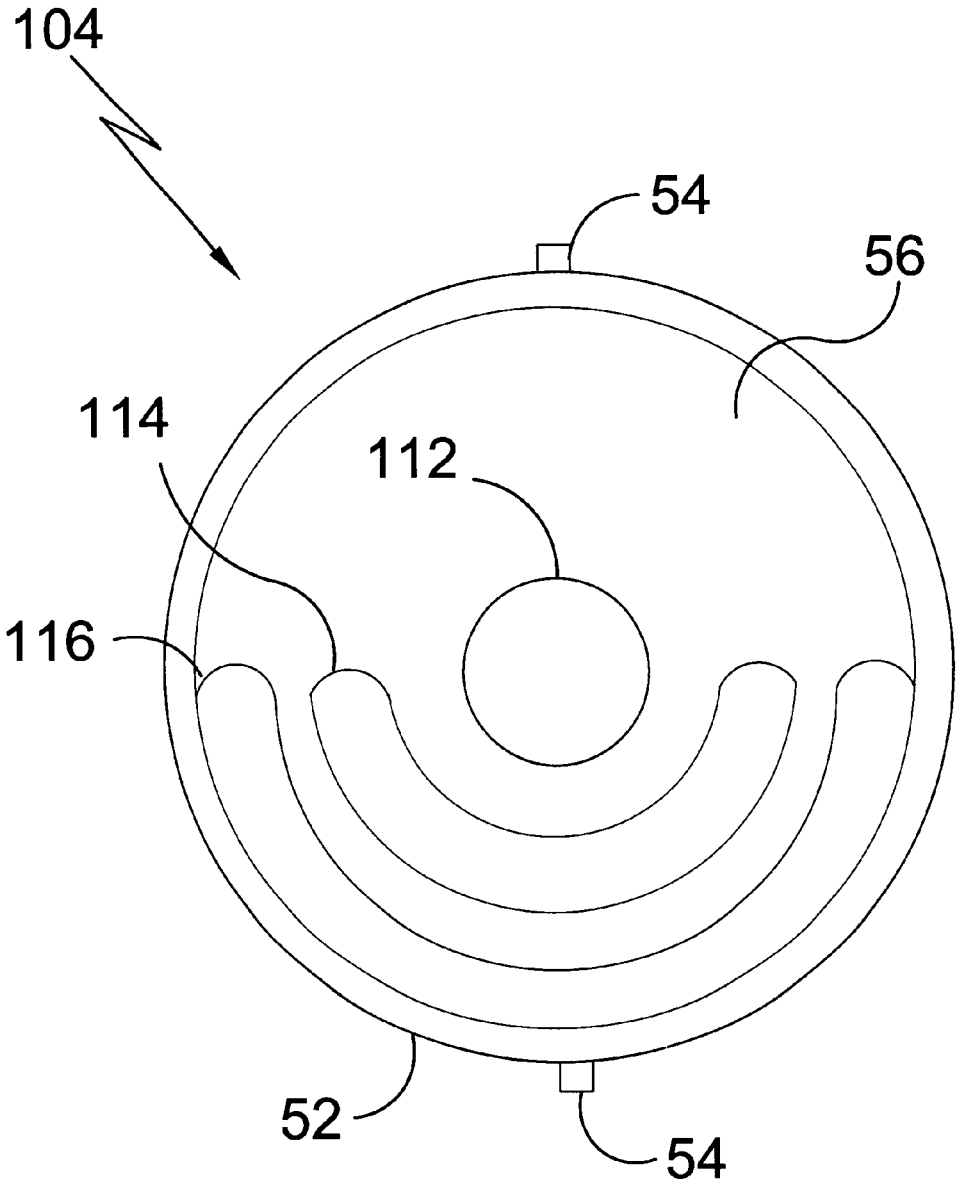
FIG. 9 is an inside view of the rotating receptacle of an alternate embodiment, showing the placement of the rotating arcuate and centrally positioned electrical contact elements.
Figure 10:
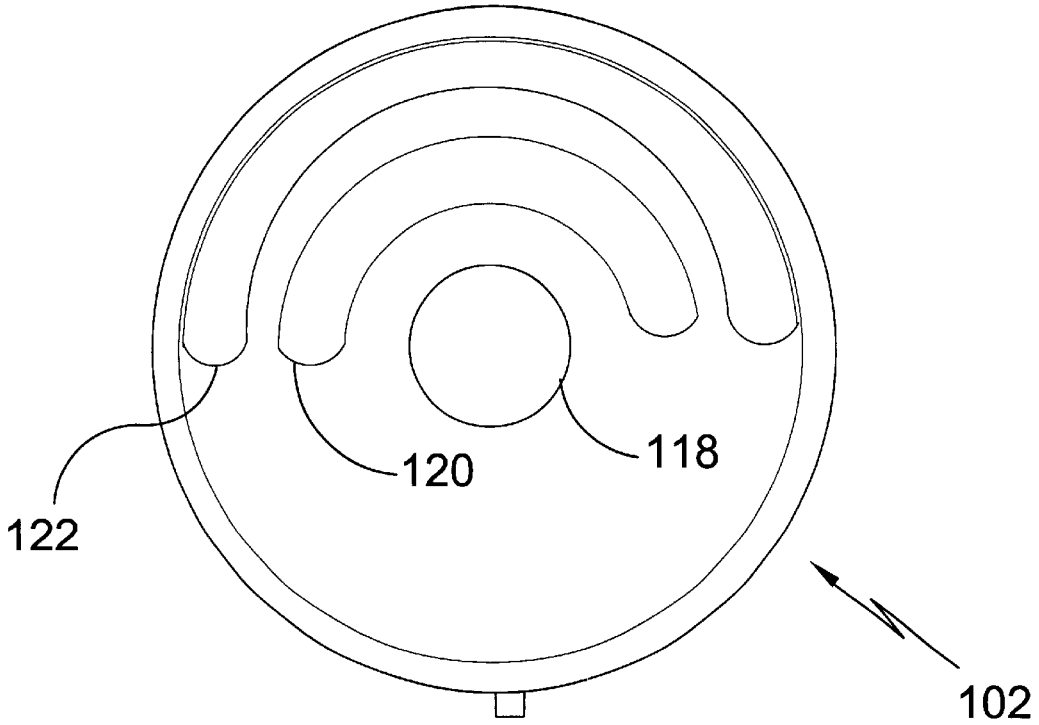
FIG. 10 is an inside view of the rotating receptacle of an alternate embodiment, showing the placement of the stationary arcuate and centrally positioned electrical contact elements.

In another embodiment, the socket 100 is configured for a three prong electrical plug, as shown in FIG. 7 and FIGS. 9–10. The body 102 and rotating receptacle 104 join in similar fashion as above, however, the rotating receptacle 104 now includes a first prong slot 106, a second prong slot 108 and a third prong slot 110, as shown in FIG. 7. A third prong receptacle is also included, the three prong receptacles receiving the three prongs and establishing electrical contact with a rotating centrally positioned contact element 112, a rotating first arcuate contact element 114, and a rotating second arcuate contact element 116, respectively.

As shown in FIGS. 9–10, the body 102 now has a stationary centrally positioned contact element 118, a stationary first arcuate contact element 120, and a stationary second arcuate contact element 122, positioned on the body 102 for continuous electrical contact (through 360 degrees) with the rotating centrally positioned contact element 112, the rotating first arcuate contact element 114, and the rotating second arcuate contact element 116, respectively.

Figure 8:
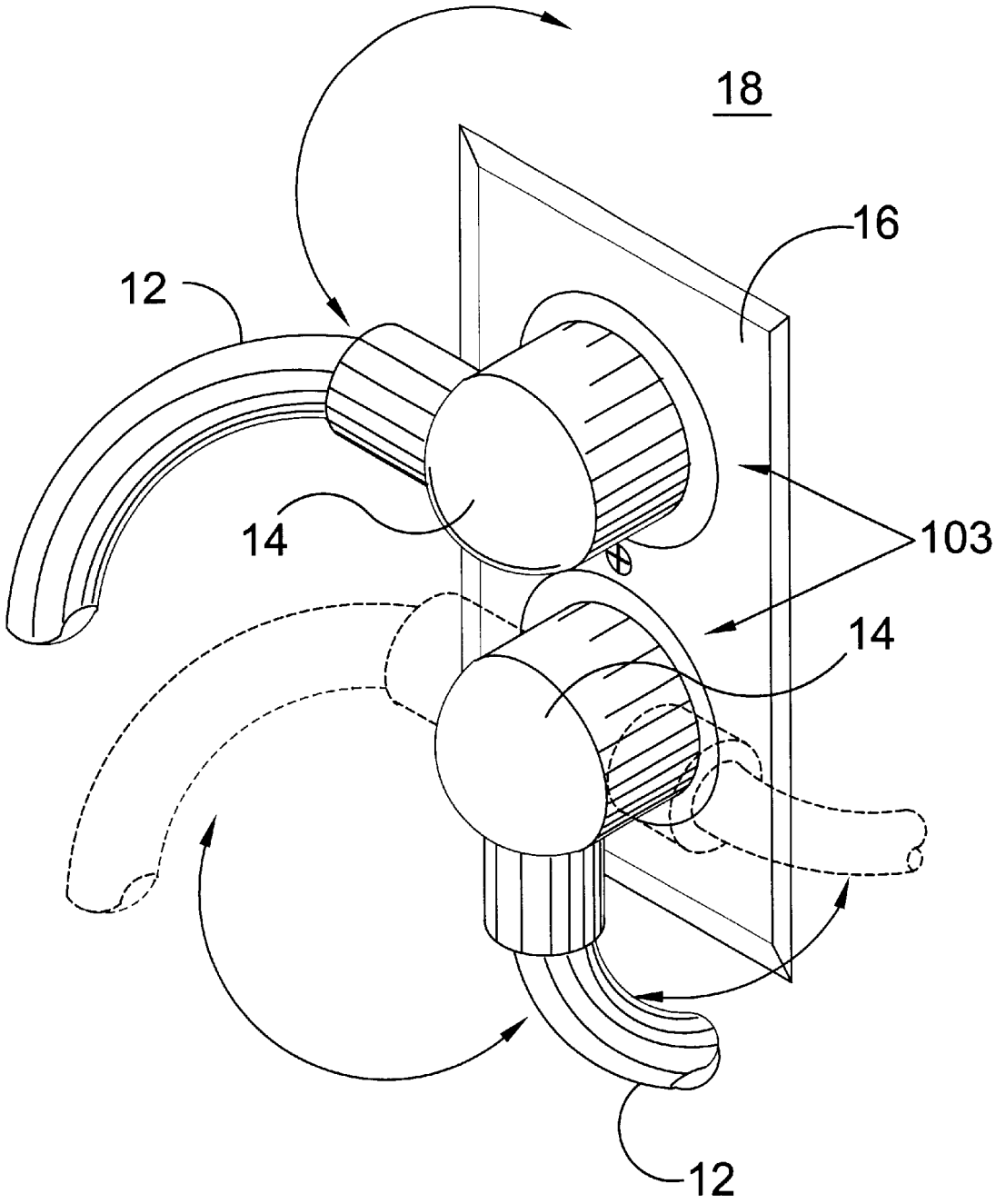
FIG. 8 is a perspective view of the present invention in use.

FIG. 7 illustrates two of the infinite number of available positions for the rotating receptacle 50. FIG. 8 depicts the positioning movements of two fully inserted electrical cord plugs 14 as facilitated by the rotational capabilities of either socket 10,100. The full 360 degree rotation range allows each plug 14 to be directed away from the other in a configuration dictated by the user's particular situation.

With respect to the above description then, it is to be realized that the optimum material and dimensional relationships for the parts of the socket 10,100, will include variations in size, materials, shape, and form, which will occur to those skilled in the art upon review of the present disclosure. For example the length of the arcs formed by the arcuate contact elements can be increased or can form complete circles. Similarly, the stationary arcuate contact elements can be reduced to a non-arcuate shape that would be placed in contact with an arcuate contact element that formed a complete, or near complete, circle. A similar configuration could include the reverse, that is reduced rotating arcuate contact elements and full, or near full, circle stationary arcuate contact elements.

Furthermore, the socket 10,100 can be adapted for use as the female end of an electrical cord or similar extension device, including both flexible and rigid extensions.

The socket 10,100 can also be fitted with corresponding components to serve plugs with more than three prongs.

The components of the socket 10,100 must be chosen for their physical strength and electrical conductivity. The conductive components, such as the contact elements, connection elements, and prong receptacles can be made from various metals typically used in electrical sockets. The non-conductive portions of the body and the rotating receptacle can be made from various plastics known to be suitable in this type of application.

All equivalent relationships to those illustrated in the drawings and described in the specification are intended to be encompassed by the present invention.

What is claimed as new and desired to be protected by Letters Patent is set forth in the appended claims:

1. An electrical socket for electrically connecting power source wires to an electrical plug having prongs, comprising:

a body having a base and an interior wall forming a body interior, the interior wall having a radial groove;

a receptacle within the body interior, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs, substantially all of the at least two prong receptacles being positioned within the portion of the receptacle that is within the body interior;

at least two rotating electrical contact elements fixed to the receptacle base, the receptacle rotating contact elements rotating with the receptacle; and at least two stationary electrical contact elements on the body base adapted to be connected to the power source wires, each of the at least two body stationary contact elements being in constant electrical connectivity with one of the at least two rotating contact elements as the receptacle is rotated through 360 degrees.

2. The socket of claim 1, wherein the receptacle rotating contact elements and the body stationary contact elements include a receptacle rotating first contact element in electrical connectivity with a body stationary first contact element, a receptacle rotating second contact element in electrical connectivity with a body stationary second contact element, and a receptacle rotating third contact element in electrical connectivity with a body stationary third contact element.

3. The socket of claim 1, wherein the receptacle rotating contact elements include at least four contact elements, and the body stationary contact elements include at least four contact elements, each of the at least four receptacle rotating contact elements being in electrical connectivity with one of the at least four body stationary contact elements.

4. The socket of claim 1, further comprising an electric cord having a first end, the first end having an electrical plug, and a second end, the second end being attached to the socket such that electricity is delivered from an electric power source through the first end plug then to the body stationary electrical contact elements in the socket.

5. The socket of claim 1, further comprising an electrical socket wall housing for positioning at least one of the sockets in a wall.

6. The socket of claim 1, wherein:

the receptacle rotating contact elements include a rotating first contact element centrally disposed on the receptacle base, and the body stationary contact elements include a stationary first contact element centrally disposed on the body base, the stationary first contact element being in constant electrical connectivity with the rotating first contact element as the receptacle is rotated through 360 degrees;

the receptacle rotating contact elements include a rotating second contact element radially disposed on the receptacle base, and the body stationary contact elements include a stationary second contact element radially disposed on the body base, the stationary second contact element being in constant electrical connectivity with the rotating second contact element as the receptacle is rotated through 360 degrees; and the receptacle rotating contact elements include a rotating third contact element radially disposed on the receptacle base, and the body stationary contact elements include a stationary third contact element radially disposed on the body base, the stationary third contact element being in constant electrical connectivity with the rotating third contact element as the receptacle is rotated through 360 degrees.

7. The socket of claim 1, wherein:

the receptacle rotating contact elements include a rotating first contact element centrally disposed on the receptacle base, and the body stationary contact elements include a stationary first contact element centrally disposed on the body base, the stationary first contact element being in constant electrical connectivity with the rotating first contact element as the receptacle is rotated through 360 degrees; and the receptacle rotating contact elements include a rotating second contact element radially disposed on the receptacle base, and the body stationary contact elements include a stationary second contact element radially disposed on the body base, the stationary second contact element being in constant electrical connectivity with the rotating second contact element as the receptacle is rotated through 360 degrees.

8. The socket of claim 7, wherein the receptacle rotating second contact element extends radially to form an arc having a length and the body stationary second contact element extends radially to form an arc having a length, the two arc lengths summing to less than 720 degrees but more than 360 degrees.

9. The socket of claim 7, wherein the receptacle rotating second contact element extends radially to form an arc having a length and the body stationary second contact element extends radially to form an arc having a length, the two arc lengths summing to less than approximately 370 degrees but more than 360 degrees.

10. An electrical socket for electrically connecting power source wires to an electrical plug having prongs, comprising:

a body having a base and an interior wall forming a body interior, the interior wall having a radial groove;

a receptacle within the body, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs;

a rotating first electrical contact element centrally disposed on the receptacle base and a stationary first contact element centrally disposed on the body base and in constant electrical connectivity with the rotating first contact element as the receptacle is rotated through 360 degrees; and a rotating second electrical contact element radially disposed on the receptacle base and a stationary second contact element radially disposed on the body base, the stationary second contact element being in electrical connectivity with the power source wires and in constant electrical connectivity with the rotating second contact element as the receptacle is rotated through 360 degrees, the rotating second contact element extending radially to form an arc having a length and the stationary second contact element extending radially to form an arc having a length, the two arc lengths summing to less than approximately 370 degrees but more than 360 degrees.

11. The socket of claim 10, wherein substantially all of the at least two prong receptacles are positioned within the portion of the receptacle that is within the body interior.

12. An electrical socket for electrically connecting power source wires to an electrical plug having prongs, comprising:

a body having a base and an interior wall forming a body interior, the interior wall having a radial groove;

a receptacle within the body, the receptacle having a base and a generally circular exterior and at least one pin positioned on the exterior and placed within the body groove such that the receptacle is rotatable within the body as the at least one pin moves within the groove, the receptacle further having at least two prong receptacles for receiving the electrical plug prongs and electrically connecting with the prongs;

a rotating first electrical contact element centrally disposed on the receptacle base and a stationary first contact element centrally disposed on the body base and in constant electrical connectivity with the rotating first contact element as the receptacle is rotated through 360 degrees; and a rotating second electrical contact element radially disposed on the receptacle base and a stationary second contact element radially disposed on the body base, the stationary second contact element being in electrical connectivity with the power source wires and in constant electrical connectivity with the rotating second contact element as the receptacle is rotated through 360 degrees, the rotating second contact element extending radially to form an arc having a length and the stationary second contact element extending radially to form an arc having a length, the two arc lengths summing to less than 720 degrees but more than 360 degrees.

13. The socket of claim 12, wherein substantially all of the at least two prong receptacles are positioned within the portion of the receptacle that is within the body interior.

14. An electrical socket for electrically connecting power source wires to an electrical plug having prongs, comprising:

a body having a base and an interior wall forming a body interior, the interior wall having a radial groove;

a receptacle within the body interior, the receptacle having a base and a generally circular exterior and two pins positioned on the exterior and placed within the body groove such that the receptacle is rotatable within the body as the two pins move within the groove, the receptacle further having three prong receptacles for receiving the electrical plug prongs and electrically connecting with the prongs, substantially all of the three prong receptacles being positioned within the portion of the receptacle that is within the body interior;

a first, second and third receptacle rotating electrical contact element fixed to the receptacle base;

a first, second and third body stationary electrical contact element on the body base adapted to be connected to the power source wires;

the receptacle rotating first contact element being centrally disposed on the receptacle base, and the body stationary first contact element being centrally disposed on the body base, the stationary first contact element being in constant electrical connectivity with the rotating first contact element as the receptacle is rotated through 360 degrees;

the receptacle rotating second contact element being radially disposed on the receptacle base, and the body stationary second contact element being radially disposed on the body base, the stationary second contact element being in constant electrical connectivity with the rotating second contact element as the receptacle is rotated through 360 degrees; and the receptacle rotating third contact element being radially disposed on the receptacle base, and the body stationary third contact element being radially disposed on the body base, the stationary third contact element being in constant electrical connectivity with the rotating third contact element as the receptacle is rotated through 360 degrees.

* * * * *